United States Patent [19]

Matsuno

[11] 4,294,435

[45] Oct. 13, 1981

[54] METHOD FOR AGITATION OF MOLTEN METAL AND FURNACE FOR AGITATION OF MOLTEN METAL

[75] Inventor: Ryohei Matsuno, Tokyo, Japan

[73] Assignees: Daido Giken Industries, Co., Ltd.; Amino Aluminium Industries, Co., Ltd., both of Tokyo, Japan

[21] Appl. No.: 971,044

[22] Filed: Dec. 19, 1978

[30] Foreign Application Priority Data

Dec. 26, 1977 [JP] Japan ..... 52-155651

[51] Int. Cl.[3] ..... H05B 5/12

[52] U.S. Cl. ..... 266/234; 13/26

[58] Field of Search ..... 13/26, 27; 164/49; 75/68 R, 10 R, 11; 266/234

[56] References Cited

U.S. PATENT DOCUMENTS

| | | | |
|---|---|---|---|
| 1,313,274 | 8/1919 | De Barros | 75/11 |
| 2,381,523 | 8/1945 | Tama et al. | 75/10 R |
| 2,875,261 | 2/1959 | Hanff | 13/26 |
| 2,963,758 | 12/1960 | Pestel et al. | 164/49 |
| 3,551,578 | 12/1970 | Hammarlund et al. | 13/26 |
| 3,759,635 | 9/1973 | Carter et al. | 75/68 R |
| 4,007,036 | 2/1977 | Gottschol et al. | 75/68 R |

*Primary Examiner*—M. J. Andrews

*Attorney, Agent, or Firm*—Oblon, Fisher, Spivak, McClelland & Maier

[57] ABSTRACT

Effective agitation of a molten metal is accomplished by means of the magnetic force exerted by an electromagnetic-wave device. A furnace capable of providing effective agitation of a molten metal is formed by providing a furnace of refractory material with an electromagnetic-wave device.

1 Claim, 11 Drawing Figures

METHOD FOR AGITATION OF MOLTEN METAL AND FURNACE FOR AGITATION OF MOLTEN METAL

BACKGROUND OF THE INVENTION

This invention relates to a method for electrically agitating a molten metal and to a furnace for providing effective agitation of a molten metal.

For the sake of convenience, the invention will be described hereinafter with reference to molten aluminum as a representative of all possible molten metals with which the present invention can be used.

Generally for the melting of metallic aluminum, there is used a reverberatory furnace the operating principle of which resides in heating the furnace ceiling and side walls such as by means of a burner and utilizing the radiant heat from the ceiling and side walls for melting the metal held inside the furnace. In this case, if the metal fused by the heating (hereinafter referred to as "molten metal") is held stationarily inside the furnace, the heat generated for the melting is transferred solely by conduction, with the result that the heat readily reaches and superheats the outer region of the entire body of molten metal but reaches the inner region thereof only after a long time. When the heat is thus conducted, it will be very long before the entire body of the metal is completely melted to the core. To expedite the melting of the metal, therefore, it becomes necessary for the molten metal to be amply agitated inside the furnace.

Agitation given to the molten metal results in a notable reduction in the time required for melting the metal, because the agitation not only eliminates local differences of temperature in the molten metal but also enables the heat to be transferred by convection. In the melting of aluminum scraps, for example, the reduction in the time required for heating decreases the duration of the exposure of the metal to the combustion gas of an elevated temperature and curtails possible melting loss of the metal.

As one way of agitating a molten metal, there has heretofore been adopted a manual means of agitation such as by use of a suitable implement like a metal bar.

This method has a disadvantage as indicated below.

Since the furnace charged with the molten metal is kept at highly elevated temperatures, the operation is required to endure bad working conditions and the manual work performed by the operator does not provide thorough agitation for the entire volume of the molten metal.

Further, the iron and the like of which the metal bar is made cannot be prevented from being melted into the molten metal and consequently impairing the composition of the molten metal. Particularly in the manufacture of an aluminum alloy, no such inclusion into the alloy of the iron can be tolerated.

There has been adopted another method which comprises forcefully blowing an inert gas such as argon or nitrogen into the molten metal so much as to cause agitation of the body of molten metal. When molten aluminum is agitated by forced blowing of nitrogen, there ensues formation of aluminum nitride which eventually collects in the form of scum on the surface of the molten aluminum. Some of the aluminum nitride is trapped within the body of molten aluminum and inevitably degrades the composition of the molten aluminum.

From the practical point of view, it is extremely difficult for the molten aluminum to be thoroughly agitated solely by the forced blowing of such an inert gas.

An object of the present invention is to provide a method for the agitation of a molten metal without entailing the least change in the composition of the molten metal.

Another object of the present invention is to provide a method for the agitation of a molten metal without exposing the operator to a bad working environment.

Still another object of this invention is to provide a device for effective agitation of a molten metal without entailing the least change in the composition of the molten metal.

A further object of this invention is to provide a device for effective agitation of a molten metal without exposing the operator to a bad working environment.

SUMMARY OF THE INVENTION

To accomplish the objects described above according to the present invention, there are provided a method which comprises establishing a magnetic field in a body of molten metal by causing an electromagnetic-wave device formed of coils and iron cores to be disposed adjacently to the body of molten metal for thereby enabling the electromagnetic-wave device to generate a propulsive force exerted upon the body of molten metal and a furnace made of a refractory material provided an electromagnetic-wave device comprising iron cores and coils so as to establish the electric field for generating the aforementioned propulsive force to be exerted upon the molten metal. The magnetic field established by the electromagnetic-wave device gives rise to an electric current within the molten metal by the phenomenon of induction, and the electric current and the magnetic field interact to generate a propulsive force which imparts agitation to the molten metal. The directionality of the agitation of molten metal can freely be selected by suitably disposing the electromagnetic-wave device so that the molten metal may be agitated horizontally or vertically with respect to the position of the melting furnace in use.

DETAILED DESCRIPTION OF THE INVENTION

The present invention will be described in detail with reference to the accompanying drawing.

Figure 1:
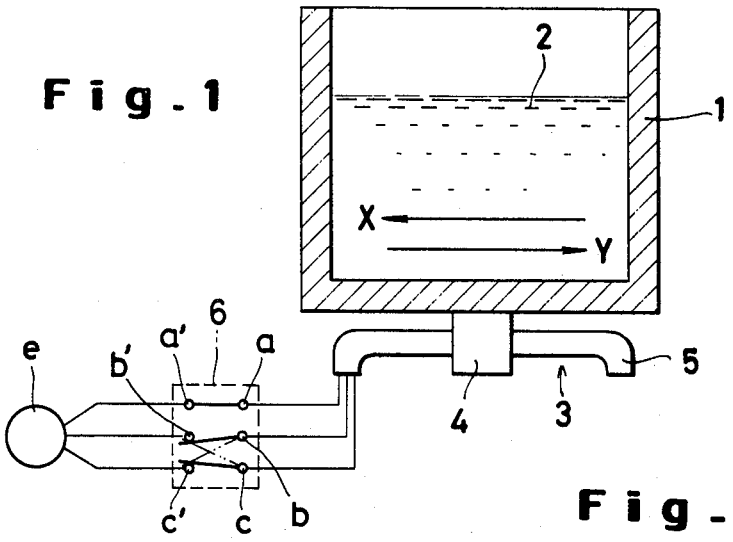
FIG. 1 is one preferred embodiment of the furnace to be used for working the present invention.

FIG. 1 is a schematic sectioned lateral view of one preferred embodiment of the melting furnace for metal according to the present invention, wherein 1 represents a melting furnace (hereinafter referred to simply as "furnace") made of a refractory, nonmagnetic material and 2 a molten mass of metallic aluminum, for example, which is kept inside the furnace 1. The furnace 1 may be of a reverberatory type such that the metal kept in the furnace will be melted by being heated with a burner (not shown).

Below the bottom of the furnace 1 is disposed an electromagnetic-wave device 3. This electromagnetic-wave device 3 has a coil 5 held in position with a core 4 which is fastened to the center of the bottom of the furnace. In the illustrated embodiment, the coil is disposed on both sides of the core 4. From the coil 5 are drawn out three terminals a, b and c which are connected to a power source e through a changeover switch 6. The terminal a is a common terminal and the terminals b and c are adapted to be switched over. When an electric current is passed to the coil 5, the coil produces to a magnetic field in one fixed direction. When the terminals b and b' are connected and the terminals c and c' are connected, for example, the magnetic field is established in the coil 5 in the direction indicated by the arrow X. When the terminals b and c' are connected and the terminals c and b' are connected, then the magnetic field is established in the coil 5 in the reverse direction indicated by the arrow Y.

The phenomenon of induction resulting from the generation of this magnetic field in the coil 5 creats to an electric current within the molten metal. The direction in which this electric current flows is identical with the direction of the magnetic field formed in the coil. Consequently, the electric current within the molten metal and the magnetic field interact to produce a magnetic action, which manifests itself as a propulsive force and consequently fluidifies the molten metal. What results is the agitation of the molten metal.

The electromagnetic-wave device of the preferred embodiment described above is adapted to cause the molten metal to be agitated simply in a horizontal direction relative to the furnace 1. This device provides a thorough agitation for the molten metal.

Figure 2:
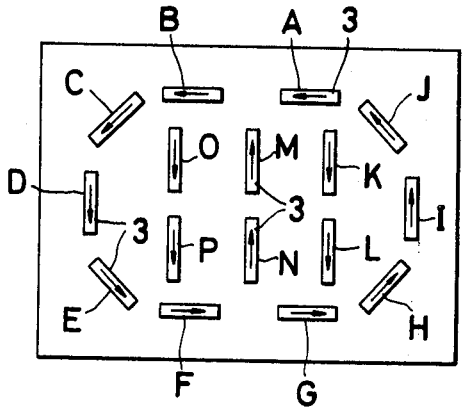
FIG. 2 is another preferred embodiment of the melting furnace of the present invention, wherein a plurality of electromagnetic-wave devices are disposed in the bottom of the furnace proper.

FIG. 2 represents another preferred embodiment which is adapted to provide more effective agitation for the molten metal than the above mentioned preferred embodiment. The electromagnetic-wave devices A, B, C, D, . . . J are disposed on a circular line and they are positioned so that their magnetic fields are oriented in one circular direction indicated by the arrows. Other electromagnetic-wave devices K, L, M. N, O and P are arranged in order as illustrated inside the circle of the aforementioned electromagnetic-wave devices and positioned so that their respective magnetic fields are oriented in one fixed direction. The molten metal 2 in the furnace 1 is caused to flow circularly in a horizontal direction with reference to the furnace 1 under the influence of the magnetic action caused by the circularly arranged electromagnetic-wave devices A through J. At the same time, the molten metal is caused to flow linearly inside the circle of the electromagnetic-wave devices. Consequently, the agitation of the molten metal is carried out with enhanced efficiency. The circular agitation of the molten metal can be sufficiently accomplished by having at least three electromagnetic-wave devices disposed at the corners of a triangle instead of using the multiplicity of electromagnetic-wave devices as described above.

Figure 3:
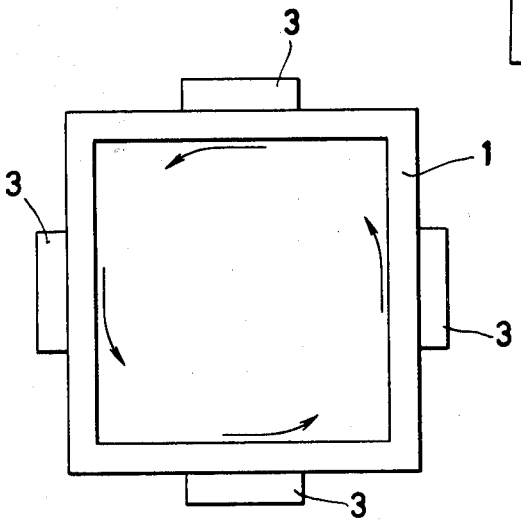
FIGS. 3–5 are other preferred embodiments of the melting furnace according to the present invention.

FIG. 3 represents still another preferred embodiment of this invention, wherein the molten metal is agitated in a circular direction by having electromagnetic-wave devices disposed one each on the outer walls of the furnace. To be more specific, the circular agitation of the molten metal is readily accomplished by having electromagnetic-wave devices disposed one each on the four outer walls so that their respective magnetic fields are oriented in one peripheral direction in a given horizontal plane. Particularly when the electromagnetic-wave devices are disposed on the outer walls of the furnace, since the directions in which the magnetic fields of such devices are oriented can be freely be changed by suitably varying the directions of the individual devices, the molten metal inside the furnace may be agitated in a vertical direction, for example, to suit the occasion. In this case, the individual electromagnetic-wave devices can be positioned more readily at a lower cost than those which are disposed below the bottom of the furnace.

Figure 4:
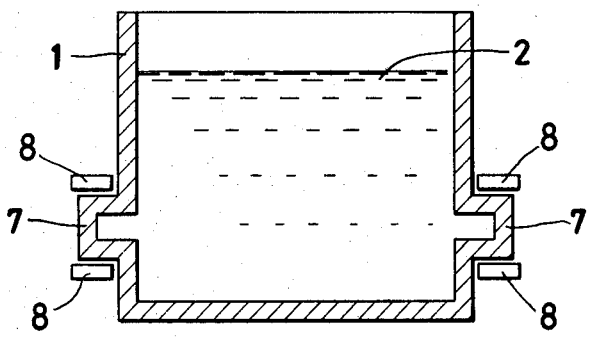

Yet another preferred embodiment of the melting furnace of the present invention having electromagnetic-wave devices disposed on the outer walls of the furnace is illustrated in FIG. 4. In this case, the furnace 1 has angular portions 7 horizontally protrude one each from the lateral walls of the furnace 1 and two electromagnetic-wave devices 8, 8 vertically opposed to each other across each of the angular protruding portions 7. Since the magnetic action generated by the opposed pairs of electromagnetic-wave devices is concentrated on the portions of the molten metal held inside the protruding portions 7, the entire mass of molten metal is agitated efficiently in a circular direction similar to that in the furnace of FIG. 3.

Figure 5:
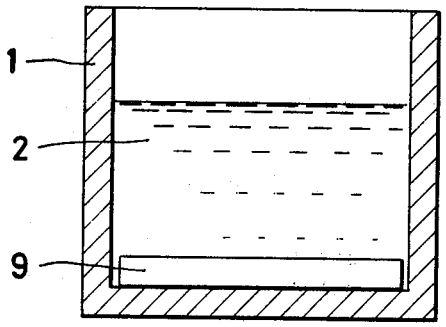

In a further preferred embodiment of the present invention for causing the agitation of molten metal, a thermally insulated sealed container 9 made of a nonmagnetic material and incorporating therein electromagnetic-wave devices is disposed on the bottom of the furnace proper containing the molten metal as illustrated in FIG. 5. In this case, the entire furnace permits ready handling because it has no electromagnetic-wave devices disposed on the outer walls of the furnace.

Although the electromagnetic-wave devices so far described are adapted to be independently disposed under the bottom of the furnace, on the outer walls of the furnace or inside the furnace proper, they may be used in any combination of the manners described above.

As described above, the furnace of the present invention permits the molten metal contained therein to be agitated into a circular motion by the magnetic action generated by the electromagnetic-wave devices. Besides, the direction in which the circular motion of the agitation is imparted to the molten metal held inside the furnace can be freely selected by suitably changing the directions of the individual electromagnetic-wave devices. Consequently, the whole mass of molten metal contained inside the furnace can be uniformly agitated without entailing any stagnation of molten metal at the corners of the furnace. The thorough agitation of molten metal results in high efficiency of the work and improved impurity of the aluminum produced. Thus, the present invention provides an epochal furnace for the metal refining industry.

The method of the present invention is better, in all respects, than the known methods involving manual agitation and physical agitation due to forced blowing of an inert gas.

The outstanding effects brought about by the method of this invention are enumerated below.

1. The product enjoys stable quality owing to elimination of otherwise possible segregation of molten metal.
2. Since the molten metal is efficiently agitated, solid metal can easily be added into the molten metal in motion without interrupting the agitation. Consequently, the time required for melting a given amount of solid metal is shortened, the yield of the melting operation improved and the energy consumption decreased.
3. Since the temperature of the furnace interior can be lowered from the level of atmospheric melting to that of molten-metal melting, the melting of the metal can be effected at a lower temperature. Consequently, the phenomenon of oxidation is deminished and the yield of the melting work is enhanced.
4. When the melting of a solid metal is started, the agitation can be started after a small amount of solid metal is melted. Consequently, the remaining solid metal can be melted in a much shorter time than is required by the conventional method.
5. The amount of metal melted in the unit time ($T/m^2H$) is greater than by the conventional method.
6. Thorough agitation of molten metal can be accomplished regardless of the depth of the molten metal.
7. The automatic control operation of melting metals can be easily carried out. The working environment involved in the melting operation is decisively improved over that by the conventional method.

Compared with the conventional method, the method of the present invention makes possible labor saving, automation of operation, improvement of operational reliability, improvement in equipment service life, increased of melting speed, continuous melting operation, improvement in product quality, stabilization of operation and reduction in operational cost.

Now, the principle underlying the operation of this invention will be described with reference to a typical experiment.

EXPERIMENT

Figure 6:
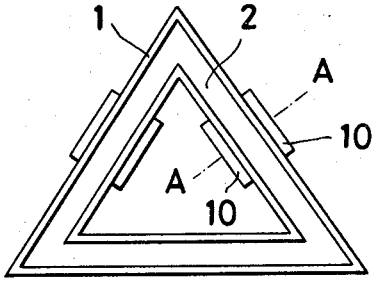
FIGS. 6–8 are schematic diagrams of experimental devices for illustrating the principle of the present invention.
Figure 7:
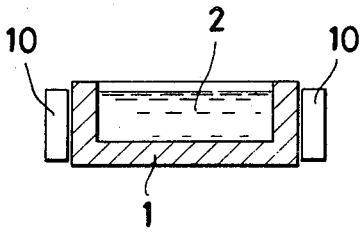

A triangular tray as illustrated in FIGS. 6 and 7 was provided with double-sided type electromagnetic-wave devices. In the tray, molten aluminum was placed and the flow of molten aluminum in the tray was measured.

FIG. 6 is a plan view of the triangular tray and FIG. 7 is a sectioned view taken along the line A—A of FIG. 6.

In the drawing of FIGS. 6 and 7, 1 represents a triangular caster-coated tray. As illustrated, two electromagnetic-wave devices 10, 10 are opposed to each other across each edge of the tray. This tray contained molten aluminum (JIS ADC 12).

The tray had a depth of 500 mm, an edge width of 200 mm and an edge length of 1500 mm in the center line.

The output of the electromagnetic-wave device was 10 KVA.

Figure 8:
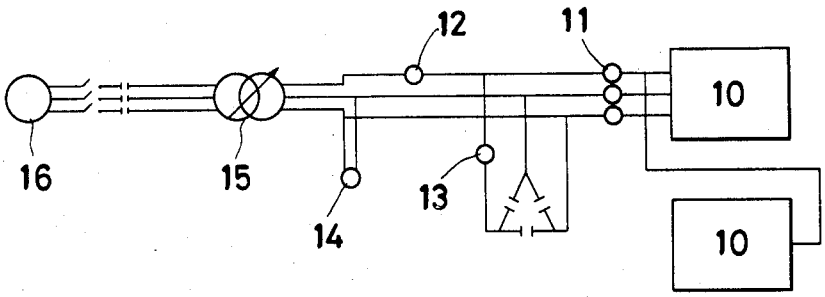

FIG. 8 represents a typical example of the wiring required for generation of electromagnetic waves in the electromagnetic-wave device. Denoted by 10 is a double-sided type electromagnetic-wave device. Denoted by 11, 12 and 13 are ammeters. By 14 is denoted a voltmeter, by 15 a slidac and by 16 a power source rated for AC 250, 50 Hz and 3-phase. With the molten aluminum kept at 700° C., the electromagnetic-wave devices were energized to generate electromagnetic waves. The results are shown below.

TABLE 1

| | Correlation between voltage and amperage | | | | |
|---|---|---|---|---|---|
| | 14 | 12 | 13 | 11 | Rate of molten aluminum flow (m/min) |
| 1 | 20 | 3.6 | 2.5 | 6.0 | 5.2 |
| 2 | 40 | 7.3 | 3.4 | 12.4 | 6.2 |
| 3 | 60 | 10.8 | 8.1 | 18.5 | 7.2 |
| 4 | 80 | 14.5 | 10.9 | 25.0 | 8.2 |
| 5 | 100 | 18.2 | 13.7 | 31.2 | 9.1 |
| 6 | 120 | 21.7 | 16.4 | 37.3 | 10.1 |
| 7 | 140 | 25.1 | 19.1 | 43.7 | 11.0 |
| 8 | 160 | 29.0 | 21.8 | 50.0 | 12.0 |
| 9 | 180 | 32.7 | 24.5 | 56.2 | 13.0 |
| 10 | 200 | 36.6 | 27.3 | 63.0 | 14.0 |
| 11 | 220 | 40.4 | 30.0 | 69.2 | 15.0 |
| 1 | 220 | 40.4 | 30.3 | 69.3 | 15.0 |
| 2 | 200 | 36.6 | 27.6 | 63.0 | 14.0 |
| 3 | 180 | 32.8 | 24.8 | 56.7 | 13.0 |
| 4 | 160 | 28.8 | 22.0 | 49.8 | 12.0 |
| 5 | 140 | 25.1 | 19.2 | 43.5 | 11.0 |
| 6 | 120 | 21.4 | 16.3 | 37.2 | 10.1 |
| 7 | 100 | 17.9 | 13.7 | 30.8 | 9.1 |
| 8 | 80 | 14.4 | 10.9 | 24.7 | 8.1 |
| 9 | 60 | 10.7 | 7.7 | 18.2 | 7.1 |

From the foregoing data, it is evident that provision of electromagnetic-wave devices permits the flow of molten metal to be effected with notably improved efficiency.

Now, the present invention will be further described hereinafter below with reference to working examples of the invention using actual furnaces.

EXAMPLE 1

An agitation melting furnace of the structure of FIG. 2 was used.

The molten aluminum used herein was in conformity with JIS ADC 12, having a specific gravity of 2.3.

In the melting furnace 2 m in length and 1.4 m in width, the molten aluminum was placed and kept at 750° C.

The furnace was provided as illustrated in FIG. 2 with electromagnetic-wave devices 16 each having an output of 1.87 KVA (1870 VA).

The distance from the electromagnetic-wave devices to the molten metal was kept at 60 mm and the volume of the molten metal was varied to determine the relation between the amount of molten metal and the rate of flow of molten metal. The variation of the amount of molten metal was effected by changing the height of the molten metal held in the furnace. The electromagnetic-wave devices were moved to cause the flow of molten metal. The results were as shown below.

TABLE 2

| Amount (depth) of molten metal (mm) | Rate of flow of molten metal (m/min) |
|---|---|
| 100 | 9.0 |
| 200 | 7.6 |
| 350 | 6.0 |
| 400 | 5.2 |
| 700 | 4.1 |

EXAMPLE 2

An agitation melting furnace of the structure of FIG. 4 was used.

The same molten aluminum as involved in Example 1 was used.

The melting furnace had a length of 2 m and a width of 1.40 m and incorporated protruding portions in the lateral walls thereof.

The protruding portions each measured 1800 mm×700 mm×200 mm. The output of the electromagnetic-wave device was 7 KVA each (28 KVA in total).

The electromagnetic-wave devices were moved and the amount of molten metal (i.e. the depth of molten metal) was varied to determine the relation between the amount of molten metal and the rate of flow of molten metal. The results were as shown below.

TABLE 3

| Depth of molten metal (mm) | Rate of flow of molten metal (m/min) |
|---|---|
| 100 | 11 |
| 200 | 8.5 |
| 300 | 7.0 |
| 400 | 6.3 |
| 700 | 5.8 |

EXAMPLE 3

Figure 9:
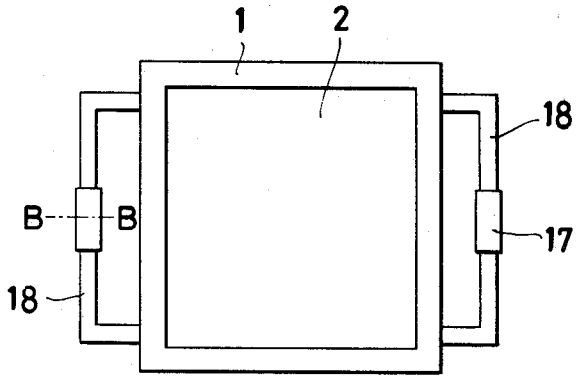
FIGS. 9–11 are still other preferred embodiments of the melting furnace of the present invention.
Figure 10:
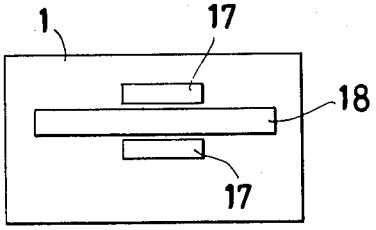
Figure 11:
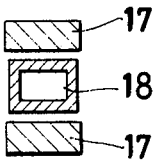

An agitation melting furnace of the structure of FIGS. 9, 10 and 11 was used. Two paths communicating with the furnace interior were disposed outside the furnace and two electromagnetic-wave devices were vertically opposed to each other across a part of each bypass. FIG. 9 represents a plan view of the furnace, FIG. 10 a side view of the furnace and FIG. 11 a sectioned view taken along the line B—B of FIG. 9.

In the drawing, 1 represents a melting furnace, 2 a molten metal, 17 an electromagnetic-wave device and 18 a bypass for the molten metal disposed outside the furnace proper.

The melting furnace was a 25-ton reverberatory furnace measuring 700 mm×2600 mm×5900 mm.

The bypass 18 for molten metal had an inside cross section of 90 mm×250 mm and an overall length of 4000 mm. The two electromagnetic-wave devices were vertically opposed to each other across this bypass and at a distance of 200 mm. The output of the electromagnetic-wave device was 7 KVA each. This melting furnace was filled with molten aluminum of JIS ADC 12 at 800° C. and the electromagnetic-wave devices were moved.

The relation between the amount of molten metal or the depth of molten metal and the rate of flow of molten metal was determined. The results were as shown below.

TABLE 4

| Depth of molten metal (mm) | Rate of flow of molten metal (m/min) |
|---|---|
| 100 | 12.0 |
| 200 | 10.6 |
| 300 | 8.9 |
| 400 | 8.1 |
| 700 | 7.4 |

What is claimed is:

1. An agitation melting furnace for molten metal, which comprises a furnace proper made of a refractory material and two sets of electromagnetic-wave devices each formed of a coil and an iron core, one set of electromagnetic-wave devices being disposed to define magnetic fields forming a circle on the outer surface of the bottom of said furnace, the magnetic fields of said one set of electromagnetic-wave devices being all in one same direction, the other set of electromagnetic-wave devices being disposed within said circle in at least one row, the magnetic fields of said other set of electromagnetic-wave devices in at least one row being all in one same direction.

* * * * *